United States Patent [19]

Naoi et al.

[11] Patent Number: 4,710,456

[45] Date of Patent: Dec. 1, 1987

[54] SILVER HALIDE PHOTOGRAPHIC MATERIAL

[75] Inventors: Takashi Naoi; Takashi Fujioka; Hisashi Okamura; Masaki Satake, all of Kanagawa, Japan

[73] Assignee: Fuji Photo Film Co., Ltd., Kanagawa, Japan

[21] Appl. No.: 774,681

[22] Filed: Sep. 11, 1985

[30] Foreign Application Priority Data

Sep. 12, 1984 [JP] Japan ..... 59-191355

[51] Int. Cl.[4] ..... G03C 1/06

[52] U.S. Cl. ..... 430/564; 430/627; 430/628; 430/630; 430/631; 430/634

[58] Field of Search ..... 430/627, 630, 631, 628, 430/564, 634

[56] References Cited

U.S. PATENT DOCUMENTS

| | | | |
|---|---|---|---|
| 3,591,387 | 7/1971 | Brust et al. | 430/627 |
| 3,764,327 | 10/1973 | Nagae et al. | 430/627 |
| 4,120,725 | 10/1978 | Nakazyo et al. | 430/630 |
| 4,367,284 | 1/1983 | Cellone et al. | 430/539 |

*Primary Examiner*—Won H. Louie

*Attorney, Agent, or Firm*—Sughrue, Mion, Zinn, Macpeak, and Seas

[57] ABSTRACT

A silver halide photographic material comprising a support and at least two silver halide emulsion layers on one or both sides of the support, wherein at least one of silver halide emulsion layers contains a polymer having a repeating unit represented by the general formula (I) and/or dextran:

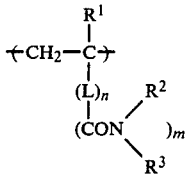

(I)

wherein $R^1$ is a hydrogen atom or an alkyl group having 1 to 6 carbon atoms; $R^2$ and $R^3$, which may be the same or different, and are each a hydrogen atom, or a group having 10 or less carbon atoms and selected from the group consisting of a substituted or unsubstituted alkyl group, a substituted or unsubstituted aryl group, and a substituted or unsubstituted aralkyl group, and $R^2$ and $R^3$ may combine together with the nitrogen atom to which they are attached to form a nitrogen-containing heterocyclic ring; L is an (m+1)-valent connecting group; n is 0 or 1; and m is 1 or 2.

8 Claims, No Drawings

SILVER HALIDE PHOTOGRAPHIC MATERIAL

FIELD OF THE INVENTION

The present invention relates to a silver halide photographic material (hereinafter sometimes referred to merely as a "light-sensitive material"). More particularly, it is concerned with a light-sensitive material which has improved covering power of developed silver without a deterioration in the adhesion between a subbing layer and a silver halide photographic emulsion layer (hereinafter sometimes referred to merely as an "emulsion layer") and roller marking properties.

BACKGROUND OF THE INVENTION

An important subject for those engaged in the preparation of emulsions is to increase the covering power of emulsion silver. The reason for this is that if the covering power is increased, the amount of silver necessary to obtain a given optical density can be reduced.

The addition of various additives to the silver halide photographic emulsion to increase the covering power of emulsion silver is known. Most of these additives as covering power-increasing agents are synthetic polymers or saccharides. A typical example of a synthetic polymer is polyacrylamide, which is described in, for example U.S. Pat. Nos. 3,271,158, and 3,514,289. A typical example of a saccharide is dextran, which is described in, for example, U.S. Pat. Nos. 3,063,838 and 3,272,631.

However, if the above covering power-increasing agents are used in an amount to fully attain the object, the following problems arise during development.

(1) The emulsion layer peels apart from the subbing layer (the layer provided to adhere together the emulsion layer and a support) during development.

(2) The mechanical strength of the emulsion layer is seriously decreased and the layer tends to be scratched.

(3) Particularly where the covering power-increasing agent is added to an X-ray-sensitive material, dot formed fog, i.e., the so-called roller marks, are formed after development using an automatic developing machine.

As can be easily understood, light-sensitive materials with the above problems have low practical value.

SUMMARY OF THE INVENTION

An object of the present invention is to provide a light-sensitive material in which the covering power is increased without a separation of the emulsion layer from the subbing layer occurring.

Another object of the present invention is to provide a light-sensitive material in which the formation of roller marks is prevented when it is subjected to a rapid processing and the covering power is increased.

Still another object of the present invention is to provide a light-sensitive material in which the covering power is increased without a serious reduction in the mechanical strength of the emulsion layer occurring.

It has been found that the above objects are attained by incorporating a polymer having a repeating unit represented by the general formula (I) as shown below and/or dextran into at least one emulsion layer of the material.

The present invention provides a silver halide photographic material comprising a support with at least two silver halide emulsion layers provided on one or both sides thereof, wherein at least one of said silver halide emulsion layers contains a polymer having a repeating unit represented by the general formula (I) and/or dextran.

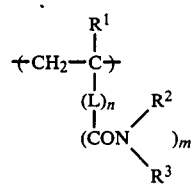

(I)

wherein $R^1$ is a hydrogen atom or an alkyl group having 1 to 6 carbon atoms; $R^2$ and $R^3$, which may be the same or different, and are each a hydrogen atom, or a group having 10 or less carbon atoms and selected from the group consisting of a substituted or unsubstituted alkyl group, a substituted or unsubstituted aryl group, and a substituted or unsubstituted aralkyl group, and $R^2$ and $R^3$ may combine together with the nitrogen atom to which they are attached to form a nitrogen-containing heterocyclic ring; L is an (m+1)-valent connecting group; n is 0 or 1; and m is 1 or 2.

DETAILED DESCRIPTION OF THE INVENTION

The term "covering power" as used herein means the value calculated using the following equation:

$$\text{Covering Power} = \frac{\text{Optical Density}}{\text{Number of Grams of Developed Silver per Square Meter}}$$

The polymer having the repeating unit of the general formula (I) is explained in detail hereinafter.

In the general formula (I), $R^1$ is a hydrogen atom or an alkyl group having 1 to 6 carbon atoms such as a methyl group, an ethyl group, an n-propyl group, an n-butyl group, an n-hexyl group, with a methyl group and an ethyl group being preferred. A hydrogen atom or a methyl group is more preferred.

$R^2$ and $R^3$, which may be the same or different, each represents a hydrogen atom, or a group having 10 or less carbon atoms and selected from the group consisting of a substituted or unsubstituted alkyl group, a substituted or unsubstituted aryl group and a substituted or unsubstituted aralkyl group. Examples of suitable substituents for the group represented by $R^2$ and $R^3$ are a hydroxyl group, a lower alkoxy group having 1 to 6 carbon atoms such as a methyl group, an ethyl group, an n-propyl group, an n-butyl group and an n-hexyl group, preferably a methyl group and an ethyl group; a halogen atom such as chlorine and bromine; an amido group such as an acetamido group and a propionamido group; a cyano group; a sulfo group; and a carboxyl group. Examples of the substituted or unsubstituted alkyl group include a methyl group, an ethyl group, an n-propyl group, an isopropyl group, an n-butyl group, an isobutyl group, a sec-butyl group, a tert-butyl group, an n-pentyl group, an n-hexyl group, a cyclohexyl group, a hydroxymethyl group, a 2-hydroxyethyl group, an ethoxymethyl group, a 2-ethoxyethyl group, a phenoxymethyl group, a 2-phenoxy-ethyl group, a benzyloxymethyl group, a 2-benzyloxyethyl group, a chloromethyl group, a 2-chloroethyl group, a bromomethyl group, a 2-bromoethyl group, a cyanomethyl group, a 2-cyanoethyl group, a

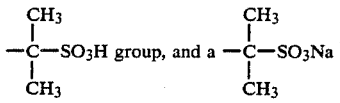

group. Examples of the substituted or unsubstituted aryl group inclue a phenyl group, o-, m- and p-tolyl groups, 2,3-, 2,4- and 2,5-xylyl groups, a mesityl group, o-, m- and p-cumenyl groups, 1- and 2-naphthyl groups, a hydroxyphenyl group, a methoxyphenyl group, an ethoxyphenyl group, a chlorophenyl group, a bromophenyl group, a cyanophenyl group, a

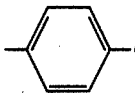

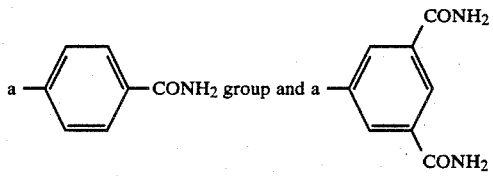

group. Examples of the substituted or unsubstituted aralkyl group include a benzyl group, a

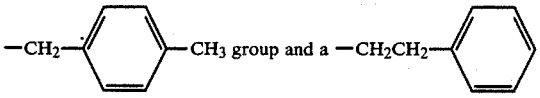

group.

$R^2$ and $R^3$ may combine together with the nitrogen atom to which they are attached to form nitrogen-containing heterocyclic ring. Examples of the combination of $R^2$ and $R^3$ include a $-CH_2-(CH_2)_2CH_2-$ group, a $-CH_2-(CH_2)_3CH_2-$ group and a $-CH_2CH_2-O-CH_2CH_2-$ group.

Preferably $R^2$ and $R^3$ are each a hydrogen atom, a methyl group, an ethyl group, or a phenyl group. More preferred is a hydrogen atom for $R^2$ and $R^3$.

L is an (m+1)-valent connecting group, preferably a divalent group. Examples of suitable divalent connecting groups are an alkylene group having 1 to 10 carbon atoms, an arylene group having 6 to 10 carbon atoms, and groups derived from the above groups and an ether bond, an ester bond, an amido bond, etc. Examples of the group represented by L include a methylene group, an ethylene group, a trimethylene group, a hexamethylene group, an o-phenylene group, an m-phenylene group, a p-phenylene group, a naphthylene group, a

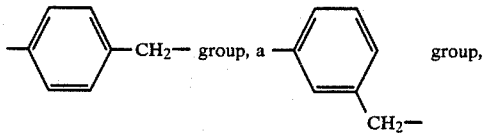

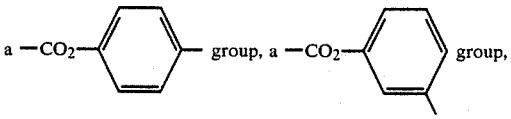

-continued

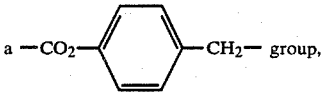

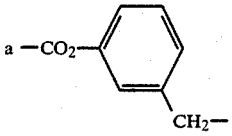

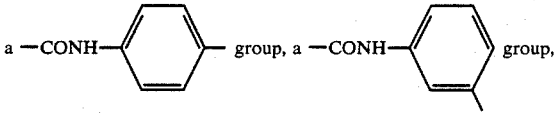

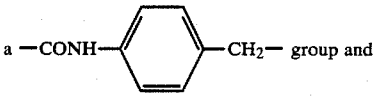

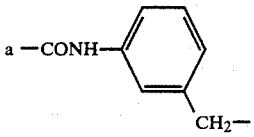

group. Preferably a methylene group, an ethylene group, a p-phenylene group, an m-phenylene group, a

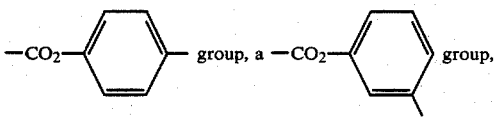

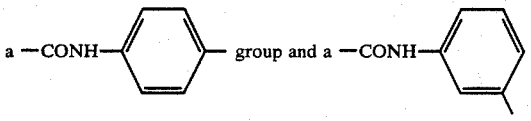

group are employed.

n is 0 or 1 and is preferably 0.

m is 1 or 2 and is preferably 1.

Preferred examples of ethylenically unsaturated monomers constituting the repeating unit of the general formula (I) are shown below.

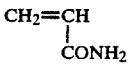

I-1

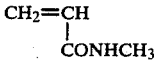

I-2

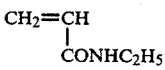

I-3

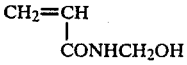

I-4

-continued

I-5

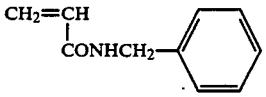

I-6

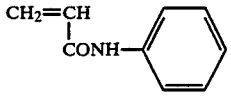

I-7

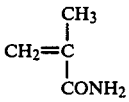

I-8

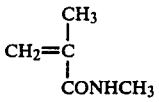

I-9

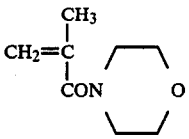

I-10

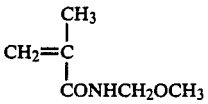

I-11

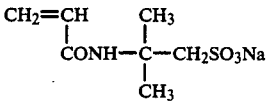

I-12

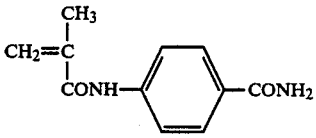

I-13

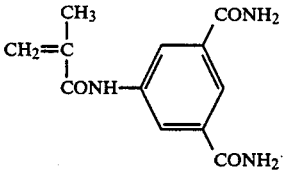

I-14

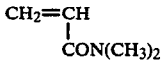

I-15

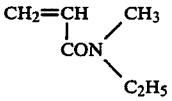

I-16

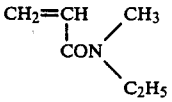

I-17

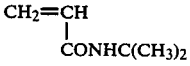

-continued

I-18

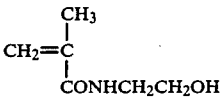

I-19

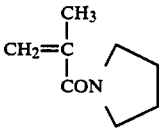

I-20

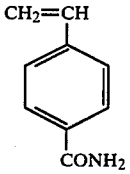

Of these, compounds represented by formulae I-1 and I-7 are particularly preferred.

The polymer of the present invention may have two or more of the repeating units represented by the general formula (I) so that a composite function is obtained.

The polymer of the present invention is a compound containing preferably at least 70 mol%, more preferably at least 80 mol%, and most preferably at least 90 mol%, of the monomer of the general formula (I) as a polymer constitution unit, as represented by the following general formula (II):

(II)

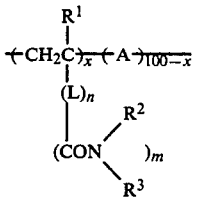

wherein $R^1$, $R^2$, $R^3$, L, m and n are as hereinbefore defined and x is the mol percentage of the repeating unit of the general formula (I) and is preferably 70 to 100, and A is a monomer unit resulting from copolymerization therewith of a copolymerizable ethylenically unsaturated monomer.

Suitable examples of such copolymerizable ethylenically unsaturated monomers which can form the repeating monomer unit A are ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzylvinylpyridinium chloride, N-vinylacetamide, N-vinylpyrrolidone, 1-vinyl-2-methylimidazole, fatty acid monoethylenically unsaturated esters (e.g., vinyl acetate and allyl acetate), ethylenically unsaturated mono- or dicarboxylic acids and their salts (e.g., acrylic acid, methacrylic acid, itaconic acid, maleic acid, sodium acrylate, potassium acrylate and sodium methacrylate), maleic anhydride, esters of ethylenically unsaturated mono- or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethyl ammonium p-toluene sulfonate, N,N-diethyl-N-methyl-N-methacryloyloxyethyl ammonium p-toluene sulfonate, dimethyl itaconate, and monobenzyl maleate), and furthermore, monomers reactive with gelatin, as described in Japanese Patent Application (OPI) No. 142524/81 (the term "OPI" as used herein refers to a "published unexamined Japanese patent application"), U.S. Pat. No. 4,352,873 and British Pat. No. 2,093,204.

The polymer of the present invention may contain two or more A monomer units so that a composite function is obtained.

Preferred examples of polymers of the present invention are shown below. The subscript shown indicates mol percentage.

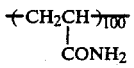
Compound (1)

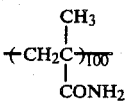
Compound (2)

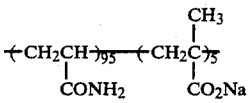
Compound (3)

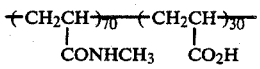
Compound (4)

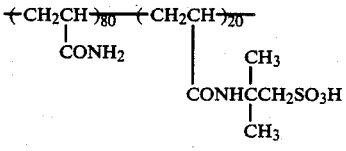
Compound (5)

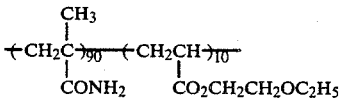
Compound (6)

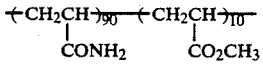
Compound (7)

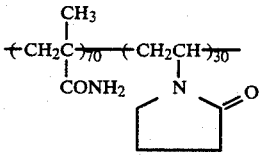
Compound (8)

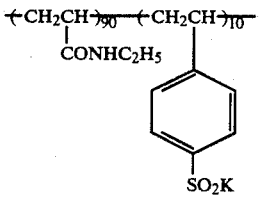
Compound (9)

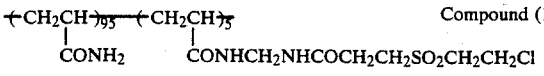
Compound (10)

-continued

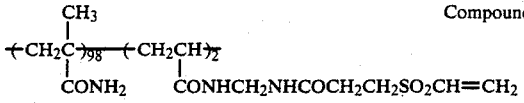
Compound (11)

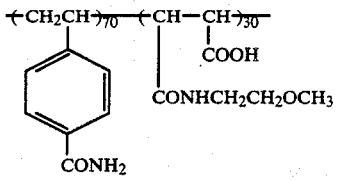
Compound (12)

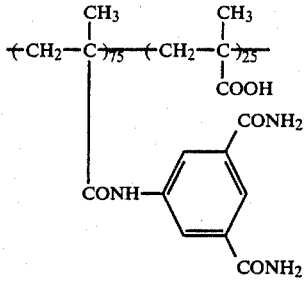
Compound (13)

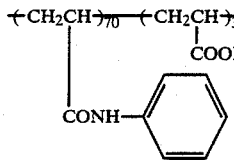
Compound (14)

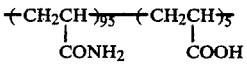
Compound (15)

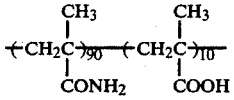
Compound (16)

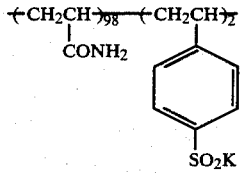
Compound (17)

Of these, Compounds (1), (2), (3), (10), (11), (15), (16) and (17) are particularly preferred.

Synthesis Examples of these compounds represented by the general formula (II) are shown below.

SYNTHESIS EXAMPLE 1

Preparation of Compound (1) (polyacrylamide)

6.25 g (0.088 mol) of acrylamide, 160 ml of methanol and 20 ml of isopropyl alcohol were placed in a 1-liter three-neck distillation flask provided with a dropping funnel, a stirrer, a reflux condenser, a nitrogen inlet tube and a thermometer, and they were stirred. Then, the mixture was heated on an oil bath kept at 60° C., and when the inner temperature of the flask was stabilized at 55° C., a solution of 3.24 g (0.014 mol) of 2,2'-azobis-dimethyl butyrate in 20 ml of methanol was added thereto, as a polymerization initiator, and the mixture was stirred for 10 minutes. Then, a solution of 93.75 g (1.32 mol) of acrylamide dissolved in 180 ml of methanol and 20 ml isopropyl alcohol was added dropwise to the above solution at a rate of 1.6 ml/min from the dropping funnel. After completion of the addition, the resulting mixture was stirred for 1 hour.

Thereafter, the heating was stopped and the flask was cooled until the inner temperature thereof reached the room temperature, thereby the reaction was terminated. The contents of the flask were filtered using a Nutsche aspirator, and the resulting white precipitate was washed with 200 ml of methanol and dried in a drier at 40° C. under the normal pressure for a night.

Yield: 83.9 g

Purity: 90.8%

Viscosity (25° C., 20% aqueous solution): 73.6 cp

Weight average molecular weight (light scattering method): 40,000

SYNTHESIS EXAMPLE 2

Preparation of Compound (15) (poly(acrylamide-co-acrylic acid))

6.25 g (0.088 mol) of acrylamide, 160 ml of methanol and 20 ml of isopropyl alcohol were placed in a three-neck distillation flask provided with a dropping funnel, a stirrer, a reflux condenser, a nitrogen inlet tube and a thermometer, and the mixture was stirred. Then, they were heated on an oil bath and when the inner temperature of the flask was stabilized at 55° C., a solution of 3.24 g (0.014 mol) of 2,2'-azobisdimethyl butyrate in 20 ml of methanol was added thereto, as a polymerization initiator, and the mixture was stirred for 10 minutes. After initiation of the polymerization reaction was confirmed (the solution became white cloudy), a solution of 89.1 g (1.25 mol) of acrylamide and 5.1 g (0.07 mol) of acrylic acid dissolved in 180 ml of methanol and 20 ml of isopropyl alcohol was added dropwise to the above solution at a rate of 1.6 ml/min from the dropping funnel. After completion of the addition, the mixture was stirred for 1 hour.

Thereafter, the heating was stopped and the flask was cooled until the inner temperature thereof reached room temperature, thereby the reaction was terminated. The contents of the flask were suction filtered using a Nutsche aspirator, and the thus obtained white precipitate was washed with 200 ml of methanol, and dried in a drier at 40° C. under the normal pressure.

Yield: 108.3 g

Purity: 89.1%

Content of acrylic acid: 5.6 mol%

Weight average molecular weight (light scattering method): 45,000

SYNTHESIS EXAMPLE 3

Preparation of Compound (17) (poly(acrylamide-co-potasssium styrenesulfite))

224.8 g (3.16 mols) of acrylamide, 13.3 g (0.064 mol) of potassium styrenesulfite and 2,500 ml of methanol were placed in a three-neck flask provided with a stirrer, a nitrogen inlet tube, a reflux condenser and a thermometer, and the mixture was stirred. The mixture was heated on an oil bath until a pale yellow transparent solution was obtained. When the inner temperature of the flask was stabilized at 58° C., a solution of 3.71 g (0.0161 mol) of 2,2'-azobisdimethylisobutyrate in 100 ml of methanol was added thereto as a polymerization initiator. Then, the solution immediately became white cloudy, thus initiation of the polymerization reaction was confirmed. The mixture was heated and stirred for additional 3.5 hours. Thereafter, for post-polymerization, a solution of 3.71 g (0.0161 mol) of 2,2'-azobisdimethylisobutyrate dissolved in 50 ml of methanol was added thereto and further the mixture was heated and stirred for 4 hours.

Thereafter, the heating was stopped and the solution was cooled to room temperature, thereby the reaction was terminated. The contents of the flask were suction filtered using a Nutsche aspirator, and the resulting white precipitate was washed with 1,000 ml (four times 250 ml) of methanol. Then, the precipitate was dried in a drier to obtain a desired polymer as white powder.

Yield: 210.6 g

Purity: 4.2%

Weight average molecular weight (light scattering method): 76,000

For the polymer of the present invention, having the repeating unit of the general formula (I), which is to be added to the emulsion layer, the weight average molecular weight ($\overline{M}w$) can range from about 5,000 to about 200,000, preferably from 7,000 to 100,000, and more preferably from 15,000 to 70,000.

Dextran to be added to the emulsion layer is prepared by allowing a dextran-producing microorganism strain, such as *Leuconostoc mesenteroides*, or dextran sucrase isolated from the culture broth of such a strain to act on a cane sugar solution to prepare native dextran and then decreasing its molecular weight by the partial depolymerization method using acids, alkalis or enzymes. The weight average molecular weight of the dextran as used herein is from about 10,000 to about 300,000, preferably from 15,000 to 100,000, and more preferably from 20,000 to 70,000.

The amount of the polymer and/or dextran added is not critical, and the optimum amount to increase the covering power varies with the type of photographic emulsion.

It is preferred that the polymer having the repeating unit of the general formula (I) and/or dextran be present in an amount of about 5 to about 50 wt% based on the total weight of binder, with a range of 30 to 40 wt% being especially preferred.

The polymer and/or dextran of the present invention may be incorporated in any emulsion layer. Preferably it is incorporated in all the emulsion layers. When two emulsion layers are used, it is preferred both of them contain the polymer and/or dextran.

More preferably the polymer and/or dextran density of the emulsion layer closer to the support is smaller than those of other emulsion layers farther from the support than the above-described emulsion layer. It is preferred that the polymer and/or dextran density of the emulsion layer closer to the support be less than 30 wt%. The term "polymer and/or dextran density" as used herein means a ratio of the weight of the polymer and/or dextran of the present invention to the weight of the binder of the layer in which the polymer and/or dextran is present.

Furthermore, if the polymer and or dextran of the present invention is also present in a light-insensitive gelatin layer adjacent the emulsion layer, better results are obtained.

Where the polymer and/or dextran of the present invention is added to all the layers of the light-sensitive material, it is preferred for the difference in the polymer and/or dextran to binder ratio between adjacent layers not to be very large, preferably not to be more than 2.5 times.

It is particularly preferred that the polymer and/or dextran density of the emulsion layer adjacent the support be smaller than those of other emulsion layers, and the amount of the polymer and/or dextran added to the emulsion layer adjacent the support be about 30 wt% or less of the binder.

The polymer and/or dextran used in the present invention may be added to a light-insensitive gelatin outermost layer. In this case, the polymer and/or dextran density of the outermost layer preferably is smaller than that of any other layer of the light-sensitive material.

The stage at which the polymer and/or dextran used in the present invention is added to the emulsion is not critical. Appropriately the polymer and/or dextran used in the present invention is added after the second aging and before the coating of the emulsion on a support.

The polymer and/or dextran of the present invention may be added in the form of powder. However, it is convenient to add such as an about 5 to 20% by weight aqueous solution.

The silver halide photographic light-sensitive material of the present invention is explained in detail hereinafter.

Silver halide grains are used in the light-sensitive material of this invention and such in the silver halide photographic emulsion as used herein may have a regular crystal form, such as a cubic or octahedral form, or an irregular crystal form, such as a spherical and plate-like form, or a composite crystal form thereof.

These photographic emulsions can be prepared using the methods described in, for example, P. Glafkides, *Chimie et Physique Photographique,* Paul Montel Co. (1967); G. F. Duffin, *Photographic Emulsion Chemistry,* The Focal Press Co. (1966); and V. L. Zelikman et al., *Making and Coating Photographic Emulsion,* The Focal Press Co. (1964). Any of the acid method, the neutral method, the ammonia method, and so forth can be employed. In reacting a soluble silver salt and a soluble halide salt, any of the single jet method, the double jet method, a combination of the single jet method and the double jet method, and so forth can be employed.

Binders which can be used include proteins such as gelatin and casein, cellulose compounds such as carboxymethyl cellulose and hydroxyethyl cellulose, sugar derivatives such as agar, sodium alginate, and starch derivatives, and synthetic hydrophilic colloids such as polyvinyl alcohol, poly-N-vinyl pyrrolidone, polyacrylic acid copolymers, or derivatives thereof and the paritally hydrolyzed products thereof.

Suitable types of gelatin which can be used include lime-treated gelatin, acid-treated gelatin, and enzyme-treated gelatin.

The light-sensitive material of the present invention can contain an alkyl acrylate-based latex as described in U.S. Pat. Nos. 3,411,911, 3,411,912 and 3,525,620 in the layers thereof.

The silver halide emulsion can be unsensitized i.e., a primitive emulsion. Usually the emulsion is chemically sensitized. For chemical sensitization, the methods described in the above-described references by P. Glafkides and V. L. Zelikman et al., and H. Frieser ed., *Die Grundlagen der Photographischen Prozesse mit Silberhalogeniden,* Akademische Verlagsgesellschaft (1968) can be employed.

In more detail, a sulfur sensitization method using compounds containing sulfur capable of reacting with silver ion or active gelatin, a reduction sensitization method using reducing substances, a noble metal sensitization method using gold and other noble metal compounds, and so forth can be used alone or in combination with each other. Sulfur sensitizers which can be used include thiosulfates, thioureas, thiazoles, rhodanines and the like. Examples of suitable sulfur sensitizers are described in U.S. Pat. Nos. 1,574,944, 2,410,689, 2,278,947, 2,728,668 and 3,656,955. Reduction sensitizers which can be used include stannous salts, amines, hydrazine derivatives, formamidinesulfinic acid, and silane compounds. Examples of suitable reduction sensitizers are described in U.S. Pat. Nos. 2,487,850, 2,419,974, 2,518,698, 2,983,609, 2,983,610 and 2,694,637. For noble metal sensitization, in addition to gold complex salts, the complex salts of Group VIII metals of the Periodic Table, such as platinum, iridium and palladium can be used. Examples of suitable noble metal salts are described in U.S. Pat. Nos. 2,399,083, 2,448,060 and British Pat. No. 618,061.

The light-sensitive material of the present invention can contain various compounds as antifoggants or stabilizers. For example, compounds known as antifoggants or stabilizers, such as azoles, e.g., benzothiazolium salts, nitroindazoles, triazoles, benzotriazoles and benzimidazoles (particularly nitro- or halo-substituted azoles); heterocyclic mercapto compounds, e.g., mercaptothiazoles, mercaptobenzothiiazoles, mercaptobenzimidazoles, mercaptothiadiazoles, mercaptotetrazoles (particularly 1-phenyl-5-mercaptotetrazole), and mercaptopyridines; the above heterocyclic mercapto compounds containing a water-solubilizing group such as a carboxyl group and a sulfone group; thioketo compounds, e.g., oxazolinethione; azaindenes, e.g., tetraazaindenes (particularly 4-hydroxy-substituted (1,3,3a,7)tetraazaindenes); benzenethiosulfonic acids; and benzenesulfinic acid can be employed.

Further details in connection with the above compounds and a method of using them are set forth in U.S. Pat. Nos. 3,954,474, 3,982,947, 4,021,248 and Japanese Patent Publication No. 28660/77.

Hardening agents which can be used include aldehyde compounds such as mucochloric acid, mucobromic acid, mucophenoxychloric acid, mucophenoxybromic acid, formaldehyde, dimethylolurea, trimethylolmelamine, glyoxal, monomethyl glyoxal, 2,3-dihydroxy-1,4-dioxane, 2,3-dihydroxy-5-methyl-1,4-dioxane, succinaldehyde, 2,5-dimethoxytetrahydrofurn, and glutaraldehyde; active vinly compounds such as divinylsulfone, methylenebismaleimide, 5-acetyl-1,3-diacryloyl-hexahydro-s-triazine, 1,3,5-triacryloyl-hexahydro-s-triazine, 1,3,5-trivinylsulfonyl-hexahydro-s-triazinebis(vinylsulfonylmethyl)ether, 1,3-bis(vinylsulfonylmethyl)propanol-2 and bis($\alpha$-vinylsulfonylacetamido)ethane; active halogen compounds such as 2,4-dichloro-6-hydroxy-s-triazine sodium salt, 2,4-dichloro-6-methoxy-s-triazine, 2,4-dichloro-6-(4-sulfoanilino)-s-triazine sodium salt, 2,4-dichloro-6-(2-sulfoethylamino)-s-triazine and N,N-bis(2-chloroethylcarbamyl)piperazine; epoxy compounds such as bis-(2,3-epoxypropyl)methylpropylammonium p-toluenesulfonate, 1,4-bis(2',3'-epoxypropyloxy)butane, 1,3,5-triglycidyl isocyanurate and 1,3-diglycidyl-5-($\gamma$-acetoxy-$\beta$-oxypropyl)isocyanurate; ethyleneimine compounds such as 2,4,6-triethyleneimino-s-triazine, 1,6-hexamethylene-N,N'-bisethyleneurea and bis-$\beta$-ethyleneiminoethyl thioether; methanesulfonic acid esters such as 1,2-di(methanesulfonyloxy)ethane, 1,4-di(methanesulfonyloxy)butane and 1,5-di(methanesulfonyloxy)pentane; carbodiimide compounds; isooxazole compounds; and inorganic compounds such as chromium alum.

The emulsion layer and other layers of the light-sensitive material of the present invention may further contain surface active agents for various purposes, for example, as coating aids, or for the prevention of charging, improvement of sliding properties, emulsification and dispersion, prevention of adhesion, and improvement of photographic characteristics (e.g., accleration of development, increasing contrast and sensitization).

Surface active agents which can be used are shown below.

Nonionic surface active agents such as saponin (steroids), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides and silicone/polyethylene oxide adducts), glycidol derivatives (e.g., alkenylsuccinic acid polyglyceride and alkylphenol polyglyceride), polyhydric alcohol fatty acid esters and sugar alkyl esters;

anionic surface active agents containing acid groups such as a carboxyl group, a sulfo group, a phospho group, a sulfate group, and a phosphate group, e.g., alkylcarboxylic acid salts, alkylsulfonic acid salt, alkylbenzenesulfonic acid salts, alkylnaphthalenesulfonic acid salts, alkylsulfuric acid esters, alkylphosphoric acid esters, N-acyl-N-alkyltauric acid, sulfosuccinic acid esters, sulfoalkylpolyoxyethylene alkylphenyl ethers, and polyoxyethylene alkylphosphoric acid esters;

amphoteric surface active agents such as aminoacids, aminoalkylsulfonic acids, aminoalkylsulfuric acid or phosphoric acid esters, alkylbetaines, and amine oxides; and cationic surface active agents such as amine salts, aliphatic or aromatic quaternary ammonium salts, heterocyclic quaternary ammonium salts such as pyridinium and imidazolium, and aliphatic or heterocyclic ring-containing phosphonium or sulfonium salts.

The photographic emulsion of the present invention may be subjected to spectral sensitization using emthine dyes, for example. Dyes which can be used for spectral sensitization include cyanine dyes, merocyanine dyes, composite cyanine dyes, composite merocyanine dyes, holopolar cyanine dyes, hemicyanine dyes, styryl dyes and hemioxonol dyes. Particularly useful dyes are cyanine dyes, merocyanine dyes and composite merocyanine dyes. These dyes can contain, as basic heterocyclic neclei, all of the nuclei commonly used for cyanine dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nuclei resulting from the fusion of alicyclic hydrocarbon rings to the above nuclei; and nuclei resulting from the fusion of aromatic hydrocarbon rings to the above nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. The carbon atoms of these nuclei may be sustituted.

The merocyanine dyes or composite merocyanine dyes may conatin, as nuclei having the ketomethylene structure, a pyrazolin-5-one nucleus, a thiohydantoin nucleus, 5- or 6-membered heterocyclic nuclei such as thiooxazolidin-2,4-dione nucleus, a thiazolidin-2,4-dione nucleus, a rhodanine nucleus and a thiobarbituric acid nucleus.

The support which can be used in the light-sensitive material of the present invention includes films composed of cellulose esters (particularly, cellulose triacetate, cellulose diacetate and cellulose propionate), polyamides, polycarbonates, polyesters (particularly, polyethylene terephthalate, poly-1,4-cyclohexanedimethylene terephthalate and polyethylene-1,2-diphenoxyethane-4,4'-dicarboxylate), polystyrenes, polypropylenes, polyethylenes, etc., and composite films comprising the above films which are coated or laminated on other support, such as paper.

Of the above films, polyethylene terephthalate films are used preferably. Particularly, biaxially stretched, heat fixed polyethylene terephthalate films are more preferred in view of stability, toughness, etc.

Thickness of the film support is not limited, but one having a thickness of from 15 to 500 μm, particularly from 40 to 200 μm, is preferred in view of easiness to handle and wide application.

The support can be transparent or contain dyes, pigments (such as titanium dioxide), silicon dioxide, alumina sol, chromium salt, zirconium salt, etc.

The present invention is described in greater detail with reference to the following examples, although the present invention is not to be construed as being limited thereto.

In the examples, the following tests were conducted.

(1) Adhesion Test (Peeling Test) in Wet Condition

At each step of development, fixation and washing, the photographic emulsion layer of the film was scratched with an iron stylus in the processing solution to form two lines crossing each other. The area including the lines as rubbed with the finger in a direction perpendicular to the line.

The rating used was as follows.

A: Peeling of the emulsion layer did not occur.

B: Peeling occurred, but the maximum width was 5 mm or less.

C: Peeling occurred and the width was more than 5 mm.

(2) Scratch Strength Test

The film was soaked in the developer. Thereafter, the swollen layer was scratched while applying a continuously changing load onto a steel hemispherical needle of 0.8 R. The minimum weight at which the surface of the layer was scratched was determined.

(3) Roller Mark Test

A light-sensitive sample was exposed and processed in an X-ray automatic developing machine (Model RN manufactured by Fuji Photo Film Co., Ltd.) for 90 seconds. This development was carried out at 38° C. for 20 seconds with a developer having the following composition.

| Developer Composition | Amount (g) |
|---|---|
| Potassium Hydroxide | 29 |
| Glacial Acetic Acid | 11 |
| Potassium Sulfite | 44 |
| Sodium Hydrogencarbonate | 7.5 |

-continued

| Developer Composition | Amount (g) |
|---|---|
| Boric Acid | 1 |
| Diethylene Glycol | 29 |
| Ethylenediaminetetraacetic Acid | 1.7 |
| 5-Methylbenzotriazole | 0.06 |
| 5-Nitroindazole | 0.25 |
| Hydroquinone | 30 |
| 1-Phenyl-3-pyrazolidone | 1.5 |
| Sodium Metahydrogensulfite | 12.6 |
| Glutaraldehyde | 1 |
| Potassium Bromide | 6 |
| Water to make (pH = 10.25) | 1 liter |

After the processing, roller marks formed on the sample was examined with the naked eye. The rating used was as follows.

A: No roller mark was formed.
B: Roller marks were formed.
C: More roller marks were formed than in B.
D: More roller marks were formed than in C.
E: More roller marks were formed than in D.

COMPARATIVE EXAMPLE

Silver Halide Emulsions A, B, C and D, each having the composition shown below, were each coated on a 180 μm thick polyethylene terephthalate film support having a subbing layer in a coating amount (calculated as the amount of silver) of 3 g/m$^2$ and then a protective layer having the composition as shown below was coated on each emulsion layer and dried to form black-and-white Silver Halide Light-Sensitive Materials (11) to (14).

Emulsion A

To a silver iodobromide gelatin emulsion containing 1.5 mol% of silver iodide (average size of silver halide grains: 1.3 μm) were added chloroauric acid and sodium thiosulfate in amounts of 0.6 mg and 3.4 mg, respectively, per mol of silver halide, and the resulting mixture was aged by heating at 60° C. for 50 minutes. To the emulsion thus prepared, 0.6 g of 4-hydroxy-6-methyl-1,3,3a,7-tetraazaindene per 100 g of silver was added as a stabilizer.

Emulsion B

Compound (1) ($\overline{M}w=60,000$) of the formula (I) used in the present invention was added to Emulsion A in such an amount as to replace 35 wt% of the gelatin of Emulsion A.

Emulsion C

Dextran ($\overline{M}w=68,000$) was added to Emulsion A in such an amount as to replace 35 wt% of the gelatin of Emulsion A.

Emulsion D

Equal amounts of Compound (1) ($\overline{M}w=68,000$) of the present invention and dextran ($\overline{M}w=68,000$) were added to Emulsion A so as to replace 35 wt% of the gelatin of Emulsion A.

Protective Layer

| | |
|---|---|
| Thickness: About 1 μm | |
| Composition and Coating Amount: | |
| Gelatin | 1.5 g/m$^2$ |
| 2,6-Dichloro-6-hydroxy-1,3,5-triazine sodium salt | 2 mmol per 100 g of the total amount of gelatin in the protective layer and the emulsion layer. |
| Sodium dodecylsulfate | 10 mg/m$^2$ |

TABLE 1

| Sample No. | Protective Layer (thickness) | Emulsion Layer (thickness) |
|---|---|---|
| (11) | 1 μm | Emulsion A (4 μm) |
| (12) | 1 μm | Emulsion B (4 μm) |
| (13) | 1 μm | Emulsion C (4 μm) |
| (14) | 1 μm | Emulsion D (4 μm) |

The test results of Samples (11) to (14) are shown in Table 2 below.

TABLE 2

| Sample No. | Covering Power | Adhesion in Wet Condition | Scratch Strength (g) | Roller Marks |
|---|---|---|---|---|
| (11) | 0.50 | A | 120 | B |
| (12) | 0.68 | C | 20 | E |
| (13) | 0.65 | C | 25 | E |
| (14) | 0.65 | C | 22 | E |

It can be seen from the above results that when the polymer of the present invention and/or dextran is added to emulsion layer, the covering power is increased, but the adhesion in wet condition and scratch strength are seriously decreased and roller marks are markedly formed.

EXAMPLE 1

An emulsion, Emulsion E, was prepared by adding the compound of the present invention, Compound (1) ($\overline{M}w=60,000$), to Emulsion A of Comparative Example so as to replace x wt% of the emulsion gelatin. This Emulsion E (x=20 wt%) was coated on a 180 μm thick polyethylene terephthalate film support which had been coated with a subbing layer, in a dry thickness of 1 μm, and, thereafter, Emulsion E in which x was controlled so that the compound of the present invention, Compound (1) ($\overline{M}w=60,000$) constituted 35 wt% of the total amount of emulsion binders (sum of the binders in a 1 μm dry thick emulsion bottom layer and in a 3 μm dry thick top layer). In this case, the amount of silver coated was controlled at 3 g/m$^2$. In addition, the protective layer of Comparative Example was coated and then dried to prepare black-and-white Silver Halide Light-Sensitive Material (21).

Light-Sensitive Material (22) was prepared in the same manner as above except that 50 wt% of Compound (1) ($\overline{M}w=60,000$) was replaced with dextran ($\overline{M}w=68,000$).

These Light-Sensitive Materials (21) and (22) and Comparative Light-Sensitive Materials (12) and (14) were tested, and the results obtained are shown in Table 3 below.

TABLE 3

| Sample No. | Covering Power | Adhesion in Wet Condition | Scratch Strength (g) | Roller Marks | Remarks |
|---|---|---|---|---|---|
| (21) | 0.68 | A–B | 40 | C | Present Invention |
| (22) | 0.66 | A–B | 43 | C | Present |

TABLE 3-continued

| Sample No. | Covering Power | Adhesion in Wet Condition | Scratch Strength (g) | Roller Marks | Remarks |
|---|---|---|---|---|---|
| (12) | 0.68 | C | 20 | E | Invention Comparative Example |
| (14) | 0.65 | C | 22 | E | Comparative Example |

It can be seen from the results of Table 3 that Light-Sensitive Materials (21) and (22) in which the emulsion layer is divided into two parts and Compound (1) and dextran are divided in two parts, although the amount per unit area of each of Compound (1) and dextran was the same, have nearly equal covering power to Comparative Light-Sensitive Materials (12) and (14) each having a single emulsion layer, but have improved adhesion in the wet condition, scratch strength, and formation of roller marks over Comparative Light-Sensitive Materials (12) and (14).

EXAMPLE 2

Emulsion E (x=20 wt%) of Example 1 was coated on a 180 μm thick polyethylene terephthalate film support which had been coated with a subbing layer, in a dry thickness of 1 μm. On the layer thus formed, Emulsion E was coated in a dry thickness of 3 μm and, furthermore, the protective layer of Comparative Example in which 12 wt% of the binder was replaced with Compound (1) ($\overline{M}w$=60,000) was coated thereon in a dry thickness of 1 μm. In this case, x of Emulsion E constituting the emulsion layer adjacent the protective layer was controlled so that the amount of Compound (1) ($\overline{M}w$=60,000) was 35 wt% of the total amount of emulsion binder (sum of the binders in a 1 μm dry thick emulsion bottom layer and in a 3 μm dry thick emulsion top layer). The amount of silver coated was 3 g/m$^2$.

These coatings were dried to prepare black-and-white Silver Halide Light-Sensitive Material (31).

Light-Sensitive Materials (32) and (33) were prepared in the same manner as above except that all of Compound (1) was replaced with dextran ($\overline{M}w$=68,000) in Material (32) and in Material (33), half of Compound (1) was replaced with the same dextran as above.

These Light-Sensitive Materials (31) to (33) and (21) and (22) were tested, and the results obtained are shown in Table 4 below.

TABLE 4

| Sample No. | Covering Power | Adhesion in Wet Condition | Scratch Strength (g) | Roller Marks |
|---|---|---|---|---|
| (31) | 0.65 | A | 45 | B-C |
| (32) | 0.64 | A | 49 | B-C |
| (33) | 0.63 | A | 52 | B-C |
| (21) | 0.68 | A-B | 40 | C |
| (22) | 0.66 | A-B | 43 | C |

It can be seen from the results in Table 4 that Light-Sensitive Materials (31), (32) and (33) in which part of Compound (1) and dextran are added also to the protective layer, although the amount per unit area of each of Compound (1) and dextran is the same, are somewhat improved over Light-Sensitive Materials (21) and (22) in adhesion in the wet condition, scratch strength, and formation of roller marks, but have decreased covering power to a certain extent as compared with Light-Sensitive Materials (21) and (22).

EXAMPLE 3

Light-Sensitive Materials (41) to (47) and (41') to (46') were prepared in the same manner as in Light-Sensitive Material (22) of Example 1 except that the weight average molecular weights of Compound (1) and dextran were changed as shown in Table 5 below.

TABLE 5

| Sample No. | Molecular Weight of Compound (1) | Molecular Weight of Dextran |
|---|---|---|
| (41) | 4,000 | 68,000 |
| (42) | 7,000 | " |
| (43) | 10,000 | " |
| (44) | 60,000 | " |
| (45) | 100,000 | " |
| (46) | 200,000 | " |
| (47) | 300,000 | " |
| (41') | 60,000 | 5,000 |
| (42') | " | 10,000 |
| (43') | " | 15,000 |
| (44') | " | 20,000 |
| (45') | " | 100,000 |
| (46') | " | 300,000 |

Light-Sensitive Materials (41) to (47) and (41') to (46') were tested, and the results obtained are shown in Table 6 below.

TABLE 6

| Sample No. | Covering Power | Adhesion in Wet Condition | Scratch Strength (g) | Roller Marks |
|---|---|---|---|---|
| (41) | 0.59 | A | 60 | C |
| (42) | 0.61 | A | 55 | C |
| (43) | 0.63 | A | 49 | C |
| (44) | 0.67 | A-B | 43 | C |
| (45) | 0.62 | B | 30 | C |
| (46) | 0.55 | B-C | 25 | C |
| (47) | 0.48 | C | 20 | C |
| (41') | 0.54 | A | 62 | D |
| (42') | 0.59 | A | 58 | D |
| (43') | 0.60 | A | 57 | C-D |
| (44') | 0.66 | A | 50 | C |
| (45') | 0.62 | B | 40 | C |
| (46') | 0.61 | C | 35 | C |

It can be seen from the results in Table 6 that an optimum molecular weight exists for both Compound (1) and dextran.

EXAMPLE 4

Emulsion E (x=15 wt%) of Example 1 was coated on a 180 μm thick polyethylene terephthalate film support which had been coated with a subbing layer, in a dry thickness of 1 μm. On the layer thus formed was coated Emulsion E in which x was controlled so that the amount of Compound (1) ($\overline{M}w$=60,000) was 10 wt%, 20 wt%, 30 wt%, 40 wt%, or 50 wt% of the total amount of binders (sum of the binders in a 1 μm dry thick emulsion bottom layer and in a 3 μm dry thick emulsion top layer), in a dry thickness of 3 μm.

The protective layer of Comparative Example was further coated in a dry thickness of 1 μm and dried to prepare a black-and-white silver halide light-sensitive material. In this way, Light-Sensitive Materials (51) to (55) were prepared. In each case, the amount of silver coated was 3 g/m$^2$.

Comparative Light-Sensitive Material (56) was prepared in the same manner as in the preparation of Material (51) except that all of Compound (1) was replaced with gelatin.

Light-Sensitive Materials (51) to (56) were tested, and the results obtained are shown in Table 7 below.

TABLE 7

| Sample No. | Covering Power | Adhesion in Wet Condition | Scratch Adhesion (g) | Roller Marks | Remarks |
|---|---|---|---|---|---|
| (51) | 0.53 | A | 80 | B | Present Invention |
| (52) | 0.56 | A | 72 | B–C | Present Invention |
| (53) | 0.61 | B | 45 | C | Present Invention |
| (54) | 0.68 | B | 38 | C | Present Invention |
| (55) | 0.75 | C | 20 | D | Present Invention |
| (56) | 0.50 | A | 120 | A | Comparative Example |

It can be seen from the results in Table 7 that the amount of the compound of the present invention added is most suitable in the range of 30 to 40 wt% based on the total weight of the binders so that all of the characteristics are satisfied.

EXAMPLE 5

Light-Sensitive Materials (61) to (63) were prepared in the same manner as in the preparation of Material (32) of Example 2 except that Compound (1) was replaced with Compound (2), Compound (8) and Compound (11), respectively.

Light-Sensitive Materials (61) to (63) and Comparative Light-Sensitive Materials (32) and (56) were tested, and the results obtained are shown in Table 8 below.

TABLE 8

| Sample No. | Covering Power | Adhesion in Wet Condition | Scratch Strength (g) | Roller Marks |
|---|---|---|---|---|
| (61) | 0.60 | A–B | 45 | B–C |
| (62) | 0.63 | A–B | 47 | B–C |
| (63) | 0.60 | A | 51 | B–C |
| (32) | 0.64 | A | 49 | B–C |
| (56) | 0.50 | A | 120 | A |

It can be seen from the results in Table 8 that Compounds (2), (8) and (11) are also effective as Compound (1).

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support with at least two silver halide emulsion layers on the same side of said support on one or both sides thereof, wherein at least two of said silver halide emulsion layers contain a polymer having a repeating unit represented by the general formula (I) and/or dextran:

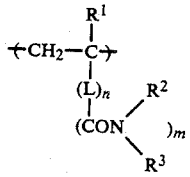

wherein $R^1$ is a hydrogen atom or an alkyl group having 1 to 6 carbon atoms; $R^2$ and $R^3$, which may be the same or different, each may represent a hydrogen atom, or a group having 10 or less carbon atoms and selected from the group consisting of a substituted or unsubstituted alkyl group, a substituted or unsubstituted aryl group, and a substituted or unsubstituted aralkyl group, and $R^2$ and $R^3$ may combine together with the nitrogen atom to which they are attached to form a nitrogen-containing heterocyclic ring; L is an (m+1)-valent connecting group; n is 0 or 1; and m is 1 or 2, and wherein the density of said polymer and/or dextran in the emulsion layer closer to the support is 30 wt% or less than that in the emulsion layer farther from the support than said closer emulsion layer, and wherein said polymer and/or dextran is present in an amount of from about 30 to 40 weight percent based on the total weight of the binder present in said emulsion layers.

2. The silver halide photographic material of claim 1, wherein the substituents on the substituted alkyl group are one or more of a hydroxyl group, a lower alkoxy group, a halogen atom, an amido group, a cyano group, a sulfo group and a carboxy group.

3. The silver halide photographic material of claim 1, wherein $R^2$ and $R^3$ each represents a hydrogen atom, a methyl group, an ethyl group or a phenyl group.

4. The silver halide photographic material of claim 1, wherein L is an alkylene group having 1 to 10 carbon atoms, an arylene group having 6 to 10 carbon atoms, a group derived from these groups and containing an ether bond, an ester bond or an amido bond.

5. The silver halide photographic material of claim 1, wherein said polymer having a repeating unit represented by the general formula (I) is represented by the general formula (II):

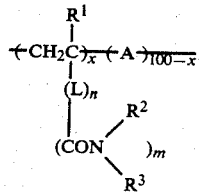

(II)

wherein $R^1$, $R^2$, $R^3$, L, m and n are as defined in claim 1, x is the mol percentage of the repeating unit of the general formula (I), and A is a monomer unit resulting from copolymerization therewith of a copolymerizable ethylenically unsaturated monomer.

6. The silver halide photographic material of claim 1, wherein the polymer having a repeating unit represented by the general formula (I) has a weight average molecular weight of from about 5,000 to about 200,000 and wherein the dextran has a weight average molecular weight of from about 10,000 to about 300,000.

7. The silver halide photographic material of claim 1, wherein said polymer having a repeating unit represented by the general formula (I) and/or dextran are/is incorporated in all of the light-sensitive silver halide emulsion layers.

8. The silver halide photographic material of claim 1, wherein the polymer having a repeating unit represented by the general formula (I) has a weight average molecular weight of from 15,000 to 70,000 and wherein the dextran has a a weight average molecular weight of 20,000 to 70,000.

* * * * *